US008141972B2

(12) United States Patent
Tatsumi

(10) Patent No.: US 8,141,972 B2
(45) Date of Patent: Mar. 27, 2012

(54) PRINTING APPARATUS AND PRINTING CONTROL METHOD

(75) Inventor: Shingo Tatsumi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 854 days.

(21) Appl. No.: 12/033,376

(22) Filed: Feb. 19, 2008

(65) Prior Publication Data

US 2008/0198201 A1 Aug. 21, 2008

(30) Foreign Application Priority Data

Feb. 21, 2007 (JP) ..... 2007-041273

(51) Int. Cl.
*B41J 29/38* (2006.01)

(52) U.S. Cl. ..... 347/9; 347/39

(58) Field of Classification Search ..... None
See application file for complete search history.

(56) References Cited

U.S. PATENT DOCUMENTS

| | | | | |
|---|---|---|---|---|
| 5,873,663 | A * | 2/1999 | Yokoi et al. | 400/279 |
| 6,742,856 | B2 | 6/2004 | Tatsumi | |
| 2007/0103496 | A1 * | 5/2007 | Otani | 347/11 |

FOREIGN PATENT DOCUMENTS

JP 2002-277231 9/2002

* cited by examiner

*Primary Examiner* — Matthew Luu
*Assistant Examiner* — Justin Seo
(74) *Attorney, Agent, or Firm* — Fitzpatrick, Cella, Harper & Scinto

(57) ABSTRACT

This invention is directed to provide a printing apparatus and a printing control method capable of more accurately obtaining a carriage position and executing more precise printing. The printing apparatus includes a scale, having slits at predetermined intervals, provided along the carriage scanning direction, and an encoder provided on a carriage to read the slits and measure the carriage position in the scanning direction as the carriage moves. In the printing apparatus, based on at least a time interval between the measurement time of a slit currently detected by the encoder and the measurement time of a slit immediately before the slit, a time up to at least one point between the currently detected slit and the next slit is predicted. Control is performed to cause a printhead mounted on the carriage to execute printing at the at least one predicted point between the continuous slits.

9 Claims, 9 Drawing Sheets

PRINTING APPARATUS AND PRINTING CONTROL METHOD

BACKGROUND OF THE INVENTION

1. Field of the Invention

The present invention relates to a printing apparatus and a printing control method. Particularly, the present invention relates to, for example, a printing apparatus which performs printing by accurately controlling the reciprocal scanning position of a carriage with an inkjet printhead, and a printing control method.

2. Description of the Related Art

A printer which prints desired information such as a text or image on a sheet-like printing medium such as a paper sheet or film is widely used as an information output device for, for example, a wordprocessor, personal computer, or facsimile apparatus.

Various printing methods are known. An inkjet method has particularly received a great deal of attention in recent years because it is quiet and capable of facilitating color printing and performing noncontact printing on a printing medium such as a printing paper sheet. An inkjet printer generally employs a serial printing method that is inexpensive and easily enables size reduction. In this method, printing is performed in accordance with desired print information while reciprocally scanning an inkjet printhead provided on a carriage in a direction perpendicular to the conveyance direction of a printing medium.

Along with the recent improvements of printing technologies, high-resolution serial printers have been introduced commercially. In such a high-resolution printer, the accuracy of position information of the carriage moving direction (main scanning direction) badly affects the printing quality.

Regarding the printer performance, not only the printing resolution but the printing speed is also required to be higher. To meet this requirement, high-speed high-resolution printers have been commercialized.

For faster printing, it is necessary to increase the moving speed in the main scanning direction. However, the higher the speed becomes, the more the accuracy of position information necessary for high-resolution printing deteriorates.

Printers using a so-called encoder to acquire accurate position information are commercially available. The encoder is designed to output the index of an absolute position in the main scanning direction of a carriage with a printhead, and for example, an optical encoder is well known.

According to arrangement of a general optical encoder, a reference (scale) having slits at very narrow intervals (predetermined intervals) is fixed along with the main scanning direction on the printer main body. A sensor provided on the carriage reads a slit, and detects the carriage moving position and speed based on the sensor output signal. The slits normally serve as printing position indices and are provided on the scale at predetermined intervals as position information (space information).

The intervals (position resolution) of the slits preferably match the actual printing resolution (printing intervals). However, when the printing resolution rises, as described above, it is necessary to manufacture a scale corresponding to the resolution and improve the sensitivity of the sensor to read information from the scale, resulting in an increase in the cost of the encoder.

To cope with high-resolution printing using an inexpensive encoder, a scale with a resolution lower than the actual printing resolution is used. Printing position information at a higher resolution is generated by interpolation based on slits formed in the scale at predetermined intervals. The carriage moving position is obtained in accordance with the printing position information, and driving of the printhead is controlled. In this case, to ensure the accuracy of printing position information, the printing region is set only within the constant-speed moving region of the carriage.

FIG. 7 is a graph showing the relationship between the carriage moving speed and the time.

Referring to FIG. 7, the abscissa represents the time, and the ordinate represents the carriage moving speed. As shown in FIG. 7, the total time required for carriage movement is B. The time of movement in the constant-speed region is A. Hence, of the time B of carriage movement, only the time A is usable for printing. The time (B−A) (acceleration/deceleration time) is unwanted for printing.

This also badly affects the size of the printer main body. More specifically, since the region for acceleration/deceleration of the carriage is necessary in the carriage scanning direction in addition to the printing region, the size of the printer in the carriage scanning direction becomes large.

To shorten the printing time, it is necessary to increase the speed in the constant-speed region and shorten the time required for acceleration/deceleration. In this case, however, the carriage must be accelerated/decelerated abruptly, and for this purpose, large kinetic energy must be given to the carriage.

To supply large kinetic energy, the driving mechanism including a carriage motor needs to be more durable. In addition, the power consumption of the driving mechanism increases. As a result, the driving mechanism becomes bulky and expensive, and this is disadvantageous for power consumption.

To solve the above problem, Japanese Patent Laid-Open No. 2002-277231 discloses an invention directed to provide a movement control apparatus, printing apparatus, and movement control method capable of accurately controlling the current position of a carriage even during acceleration/deceleration.

An apparatus disclosed in Japanese Patent Laid-Open No. 2002-277231 has the following components: a sensor which is attached to a carriage moving along a scale with a plurality of slits provided at predetermined intervals and detects a slit, a means for predicting the time until next slit detection based on the sensor output, and a means for generating a signal related to the current carriage position based on the predicted time.

FIG. 8 is a block diagram showing the carriage position detection unit in the apparatus disclosed in Japanese Patent Laid-Open No. 2002-277231.

Referring to FIG. 8, a scale 101 has a plurality of slits at predetermined intervals. An encoder sensor 102 detects a slit of the scale 101. The encoder sensor 102 includes a light-emitting element 121 which irradiates the scale 101 with light, and a light-receiving element 122 which receives light that has passed through the slits of the scale 101. A detection unit 103 detects an output signal from the encoder sensor 102. An acceleration/deceleration prediction unit 104 predicts acceleration or deceleration of the carriage based on the detection signal from the detection unit 103 and predicts the time from the current detected slit to the next slit.

A printing position generation unit 105 generates a printing position signal of the printhead. A prediction interpolator 106 obtains position information at a resolution equal to or more than that of the scale 101 by interpolation based on an output signal (Tx) from the acceleration/deceleration prediction unit.

The detection unit 103, acceleration/deceleration prediction unit 104, printing position generation unit 105, and prediction interpolator 106 operate based on a clock signal (CLK) supplied to them.

As described above, the apparatus disclosed in Japanese Patent Laid-Open No. 2002-277231 predicts the time until the next slit detection. Hence, acceleration/deceleration printing can be performed more satisfactorily than before.

In the above prior art, however, the printing position generation unit generates the signal related to the current carriage position depending on only the predicted time. Hence, the accuracy of the current position information is poor.

More specifically, the carriage accelerates/decelerates even during the time up to the predicted time. According to Japanese Patent Laid-Open No. 2002-277231, the carriage positions up to the predicted time are obtained by equally dividing the predicted time. For this reason, no information that reflects the accelerated motion in a very small region is obtained.

If the acceleration of the carriage is small, the conventional prediction approximately poses no problem. However, when the carriage moving speed increases, and the printing resolution becomes higher, the accelerated motion in the very small region is also not negligible.

SUMMARY OF THE INVENTION

Accordingly, the present invention is conceived as a response to the above-described disadvantages of the conventional art.

For example, a printing apparatus and printing control method according to this invention are capable of more accurately obtaining a carriage position and executing more precise printing.

According to one aspect of the present invention, preferably, there is provided a printing apparatus for printing by scanning a printhead, comprising: generation means for generating a signal as the printhead moves; prediction means for predicting, bases on time intervals of signal generation, a time interval up to a signal to be generated next; division means for dividing the time interval predicted by the prediction means into a plurality of periods such that lengths of the divided periods have equal differences in chronological order; and driving means for driving the printhead at a timing based on the periods divided by the division means.

According to another aspect of the present invention, preferably, there is provided a method of controlling a printing apparatus for printing by scanning a printhead, comprising the steps of: generating a signal as the printhead moves; predicting, based on time intervals of signal generation, a time interval up to a signal to be generated next; dividing the time interval predicted at the predicting step into a plurality of periods such that lengths of the divided periods have equal differences in chronological order; and driving the printhead at a timing based on the periods divided at the dividing step.

According to still another aspect of the present invention, preferably, there is provided a printing apparatus including a scale, having slits at predetermined intervals, provided along a scanning direction of a carriage, and an encoder provided on the carriage to read the slits of the scale and measure a position of the carriage in the scanning direction as the carriage moves, comprising: interpolation prediction means for predicting, based on at least a time interval between a measurement time of a slit currently detected by the encoder and a measurement time of a slit immediately before the currently detected slit, a time up to at least one position between the currently detected slit and a next slit; and control means for controlling to cause a printhead mounted on the carriage to execute printing at the at least one position between the continuous slits predicted by the interpolation prediction means.

According to still another aspect of the present invention, preferably, there is provided a method of controlling a printing apparatus including a scale, having slits at predetermined intervals, provided along a scanning direction of a carriage, and an encoder provided on the carriage to read the slits of the scale and measure a position of the carriage in the scanning direction as the carriage moves, comprising the steps of: predicting, based on at least a time interval between a measurement time of a slit currently detected by the encoder and a measurement time of a slit immediately before the currently detected slit, a time up to at least one position between the currently detected slit and a next slit; and controlling to cause a printhead mounted on the carriage to execute printing at the at least one position between the continuous slits predicted at the predicting step.

The invention is particularly advantageous since the measurement times of a currently detected slit and an immediately preceding slit and the time interval between them are used to predict a printing point between the currently detected slit and the next slit so that the information of the accelerated motion of the carriage is reflected, and more accurate position detection can be performed.

This allows executing more precise printing at a resolution higher than the spatial resolution of the slits even during more abrupt acceleration/deceleration than before.

Further features of the present invention will become apparent from the following description of exemplary embodiments (with reference to the attached drawings).

DESCRIPTION OF THE EMBODIMENTS

Figure 1:
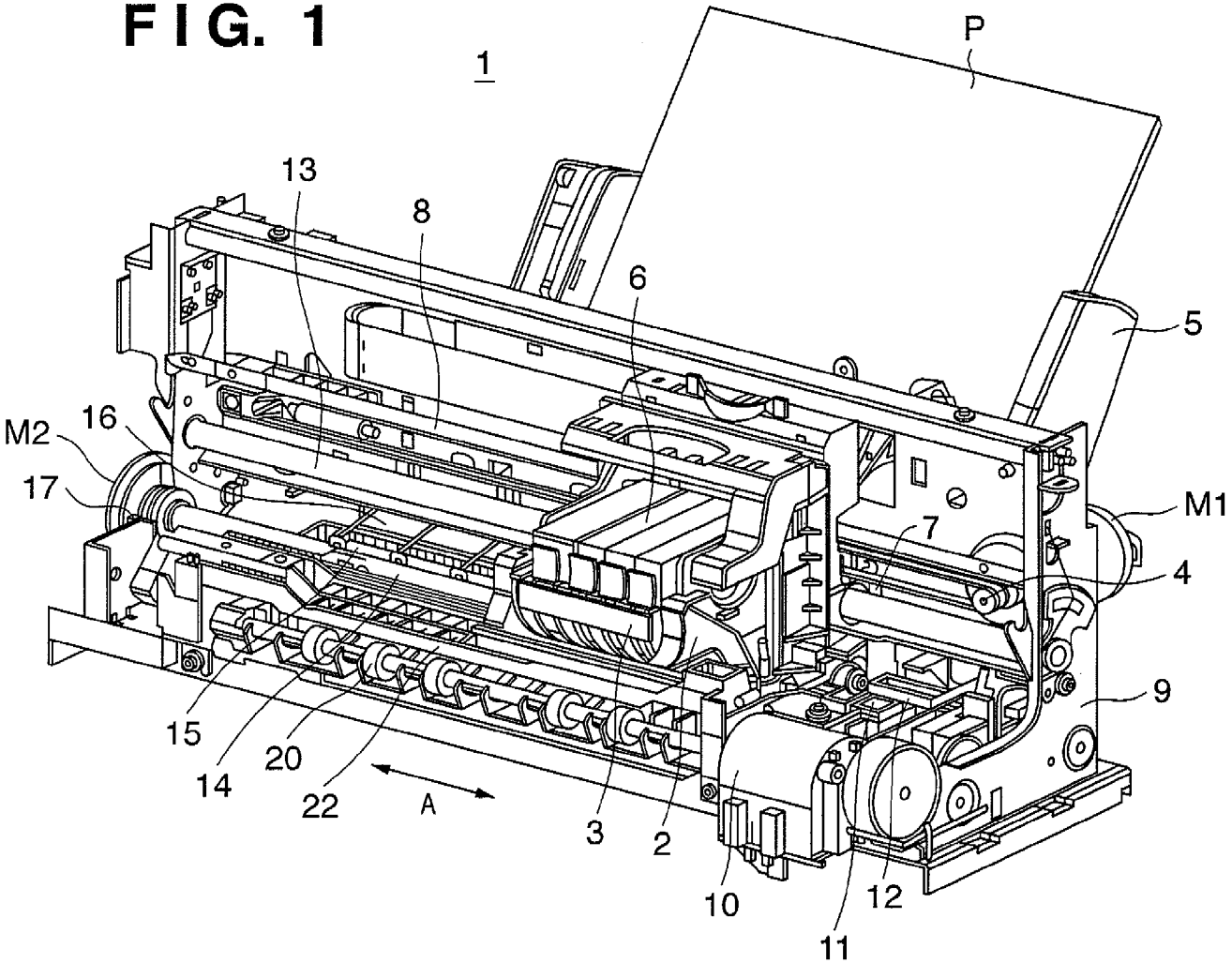
FIG. 1 is an external perspective view showing the schematic arrangement of an inkjet printing apparatus according to a typical embodiment of the present invention.

Preferred embodiments of the present invention will now be described in detail in accordance with the accompanying drawings. The same reference numerals as in the above description denote the same parts, and a description thereof will not be repeated.

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink (e.g., can solidify or insolubilize a coloring agent contained in ink applied to the print medium).

Furthermore, unless otherwise stated, the term "printing element" generally means a set of a discharge orifice, a liquid channel connected to the orifice and an element to generate energy utilized for ink discharge.

<Description of Inkjet Printing Apparatus (FIG. 1)>

FIG. 1 is an external perspective view showing the schematic arrangement of an inkjet printing apparatus 1 according to a typical embodiment of the present invention.

As shown in FIG. 1, the inkjet printing apparatus (to be referred to as a printing apparatus hereinafter) has, on a carriage 2, a printhead 3 which discharges ink to execute printing in accordance with the inkjet method. A transmission mechanism 4 transmits, to the carriage 2, a driving force generated by a carriage motor M1 to move the carriage 2 reciprocally in the direction of an arrow A. In printing, a printing medium P such as a printing paper sheet is fed via a feed mechanism 5 and conveyed to a printing position. At the printing position, the printhead 3 discharges ink to the printing medium P, thereby performing printing.

To keep the printhead 3 in good condition, the carriage 2 is moved to the position of a recovery unit 10, and the discharge recovery process of the printhead 3 is intermittently executed.

The carriage 2 of the printing apparatus 1 has not only the printhead 3 but also an ink cartridge 6 which contains ink to be supplied to the printhead 3. The ink cartridge 6 is detachable from the carriage 2.

The printing apparatus 1 shown in FIG. 1 can execute color printing. For this purpose, the carriage 2 has four ink cartridges which contain magenta (M), cyan (C), yellow (Y), and black (K) inks, respectively. The four ink cartridges are independently detachable.

The carriage 2 and printhead 3 can achieve and maintain necessary electrical connection by appropriately bringing their joint surfaces into contact. The printhead 3 receives energy in accordance with a print signal and selectively discharges ink from a plurality of orifices, thereby printing. In particular, the printhead 3 of this embodiment employs an inkjet method to discharge ink by using thermal energy and therefore has electrothermal transducers to generate thermal energy. Electrical energy is applied to the electrothermal transducers and converted into a thermal energy. When the thermal energy is applied to the ink, film boiling occurs, and the ink is discharged from the orifices by using a change in the pressure caused by growth/shrinkage of bubbles created by the film boiling. The electrothermal transducers are provided in correspondence with the respective orifices. When a pulse voltage is applied to an electrothermal transducer in accordance with a print signal, a corresponding orifice discharges ink.

As shown in FIG. 1, the carriage 2 is coupled with a part of a driving belt 7 of the transmission mechanism 4 for transmitting the driving force of the carriage motor M1 and guided and supported along a guide shaft 13 to be slidable in the direction of the arrow A. Hence, the carriage 2 reciprocally moves along the guide shaft 13 as the carriage motor M1 rotates in the forward and reverse directions. A scale 8 for indicating the absolute position of the carriage 2 is provided along the moving direction (the direction of the arrow A or the scanning direction) of the carriage 2. In this embodiment, the scale 8 is formed by printing black bars on a transparent PET film at necessary pitches. One end of the scale 8 is fixed on a chassis 9, and the other end is supported by a leaf spring (not shown).

The printing apparatus 1 has a platen (not shown) that opposes the orifice surface of the printhead 3 with the orifices (not shown). The carriage 2 with the printhead 3 is reciprocally moved by the driving force of the carriage motor M1. A print signal is simultaneously supplied to the printhead 3 to discharge ink so that the printing medium P conveyed onto the platen is printed throughout its width.

Referring to FIG. 1, a conveyance roller 14 is driven by a conveyance motor M2 to convey the printing medium P. A pinch roller 15 presses the printing medium P against the conveyance roller 14 via a spring (not shown). A pinch roller holder 16 rotatably holds the pinch roller 15. A conveyance roller gear 17 is fixed to one end of the conveyance roller 14. The rotation of the conveyance motor M2 is transmitted to the conveyance roller gear 17 via an intermediate gear (not shown) to drive the conveyance roller 14.

A discharge roller 20 discharges, from the printing apparatus 1, the printing medium P having an image formed by the printhead 3. The discharge roller 20 is driven upon receiving the rotation of the conveyance motor M2. The discharge roller 20 presses the printing medium P against a spur roller (not shown) via a spring (not shown). A spur holder 22 rotatably supports the spur roller.

The printing apparatus 1 also has a recovery unit 10 for recovering a discharge failure of the printhead 3 at a position (e.g., a position corresponding to the home position) outside the range of the reciprocal motion (outside the printing region) for the printing operation of the carriage 2 with the printhead 3.

The recovery unit 10 includes a capping mechanism 11 for capping the orifice surface of the printhead 3 and a wiping mechanism 12 for cleaning the orifice surface of the printhead 3. In synchronism with orifice surface capping by the capping mechanism 11, a suction means (e.g., suction pump) in the recovery unit forcibly sucks the ink out of the orifices. A discharge recovery process is thus executed to, for example, remove highly viscous ink or bubbles from the ink channels of the printhead 3.

In, for example, a non-printing operation, the capping mechanism 11 caps the orifice surface of the printhead 3 to protect the printhead 3 and prevent the ink from evaporating and drying. On the other hand, the wiping mechanism 12 located near the capping mechanism 11 wipes off ink droplets sticking to the orifice surface of the printhead 3.

The capping mechanism 11 and wiping mechanism 12 maintain the normal ink discharge state of the printhead 3.

<Control Arrangement of Inkjet Printing Apparatus (FIG. 2)>

Figure 2:
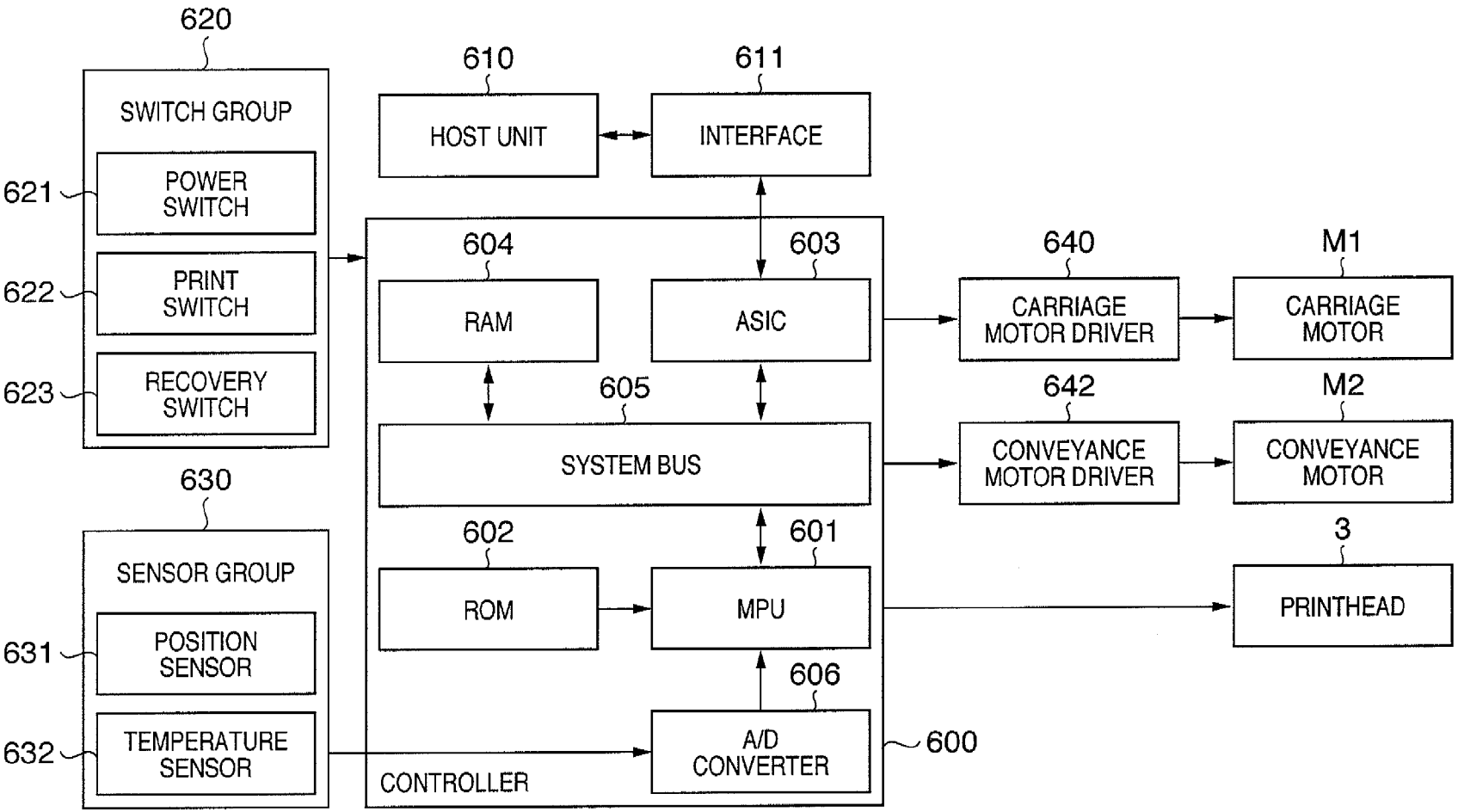
FIG. 2 is a block diagram showing the arrangement of the control circuit of the printing apparatus.

FIG. 2 is a block diagram showing the control arrangement of the printing apparatus shown in FIG. 1.

As shown in FIG. 2, a controller 600 has an MPU 601, ROM 602, application specific integrated circuit (ASIC) 603, RAM 604, system bus 605, and A/D converter 606. The ROM 602 stores programs corresponding to control sequences to be described later, necessary tables, and other permanent data. The ASIC 603 generates control signals to control the carriage motor M1, conveyance motor M2, and printhead 3. The RAM 604 serves as an image data rasterization area and a work area for program execution. The system bus 605 connects the MPU 601, ASIC 603, and RAM 604 to each other and transfers data. The A/D converter 606 converts an analog signal received from a sensor group (to be described below) into a digital signal and supplies it to the MPU 601.

Referring to FIG. 2, a computer (or a reader for reading an image or a digital camera) serving as an image data supply source is called a host unit. The host unit 610 and printing apparatus 1 exchange image data, commands, and status signals via an interface (I/F) 611. The image data is input in, for example, a raster format.

A switch group 620 includes a power switch 621, print switch 622, and recovery switch 623.

A sensor group 630 includes a position sensor 631, and temperature sensor 632.

A carriage motor driver 640 drives the carriage motor M1 to reciprocally scan the carriage 2 in the direction of the arrow A. A conveyance motor driver 642 drives the conveyance motor M2 to convey the printing medium P.

In printing and scanning of the printhead 3, the ASIC 603 transfers the drive data (DATA) of printing elements (discharge heaters) to the printhead while directly accessing the storage area of the RAM 604.

In the arrangement illustrated in FIG. 1, the ink cartridge 6 is separable from the printhead 3. However, an exchangeable head cartridge in which the ink cartridge 6 and printhead 3 are integrated may be formed.

Figure 3:
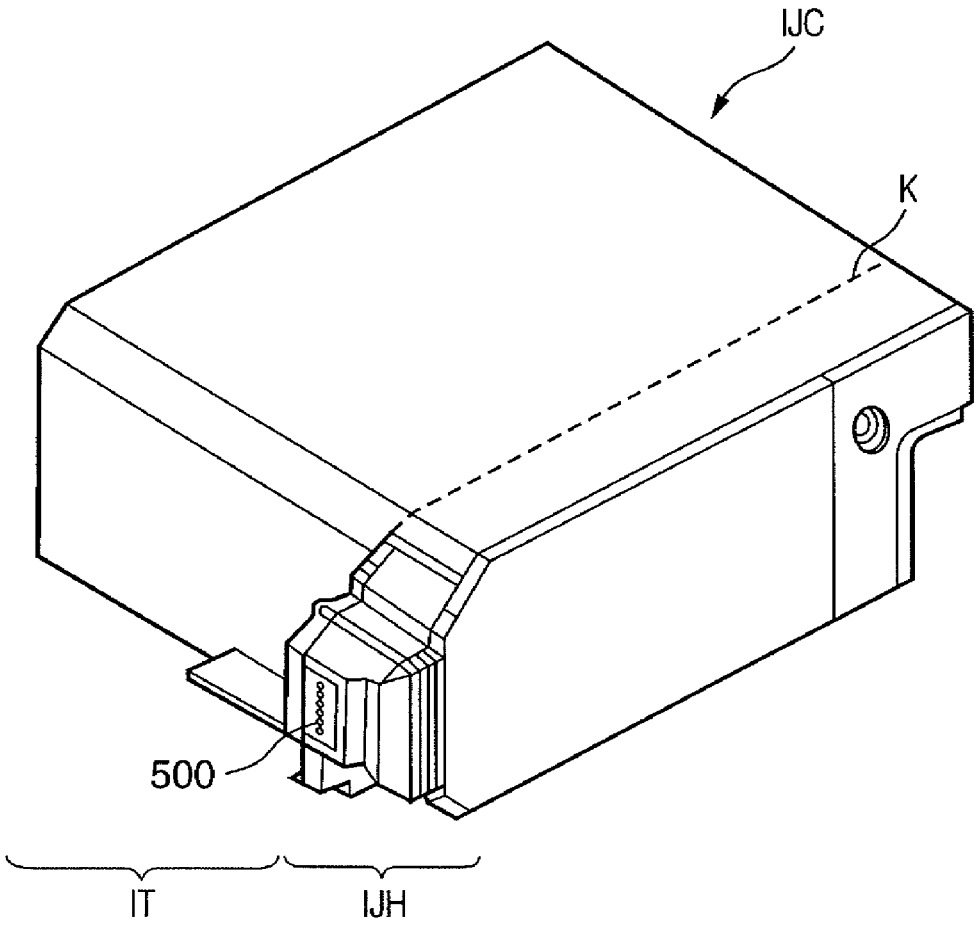
FIG. 3 is an external perspective view showing the arrangement of a head cartridge IJC in which an ink tank and a printhead are integrated.

FIG. 3 is an external perspective view showing the arrangement of a head cartridge IJC that integrates the ink tank and printhead. Referring to FIG. 3, a dotted line K indicates the boundary between an ink tank IT and a printhead IJH. The head cartridge IJC has an electrode (not shown) that receives an electrical signal supplied from the side of the carriage 2 when the head cartridge is mounted on the carriage 2. The electrical signal drives the printhead IJH to discharge the ink, as described above.

Reference numeral 500 in FIG. 3 denotes an orifice array.

Figure 4:
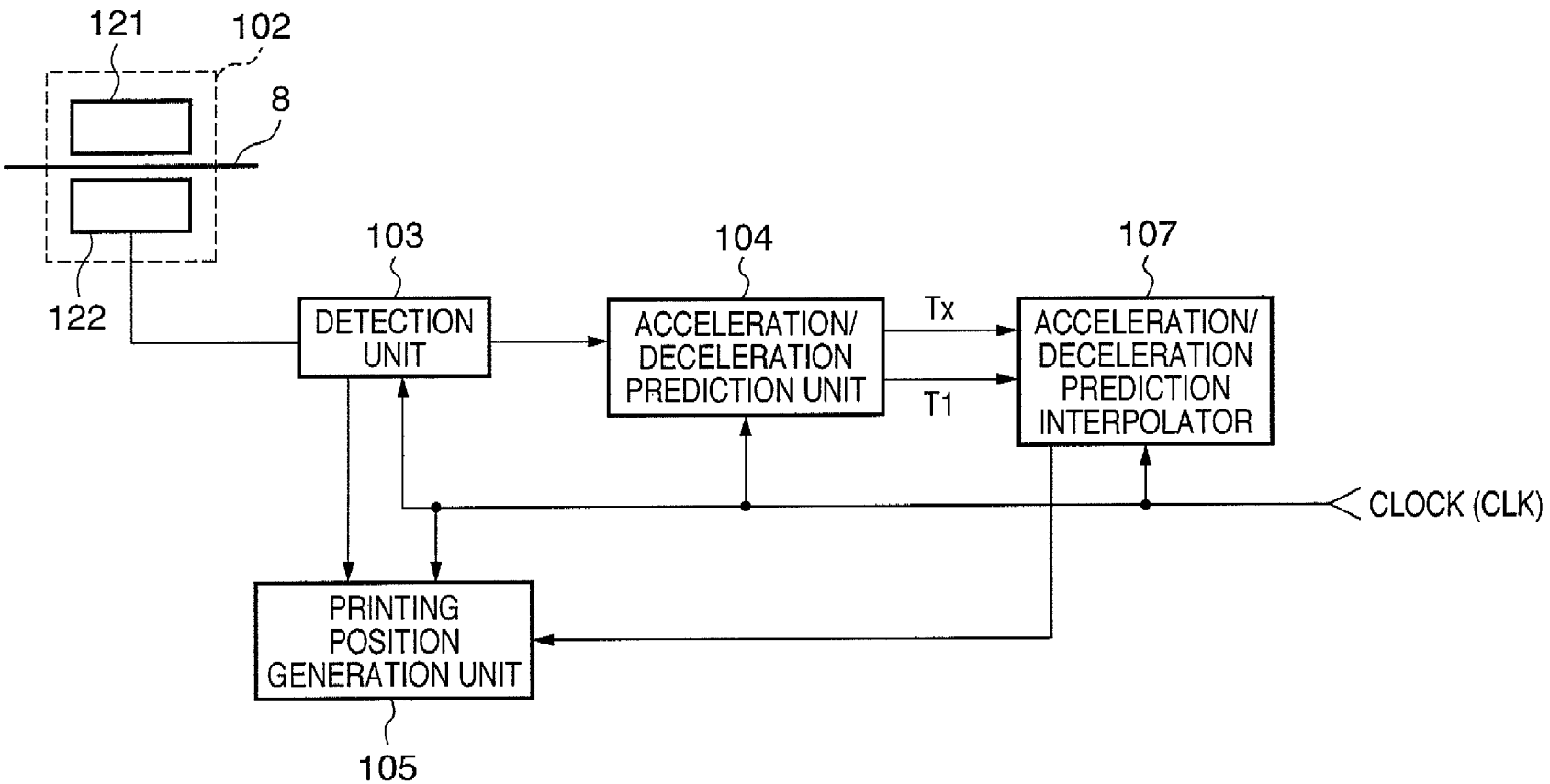
FIG. 4 is a block diagram showing the carriage position detection unit of the printing apparatus shown in FIG. 1.

FIG. 4 is a block diagram showing the carriage position detection unit of the printing apparatus shown in FIG. 1.

The same reference numerals as those of the prior art described with reference to FIG. 8 denote the same parts, and a description thereof will not be repeated.

Figure 8:
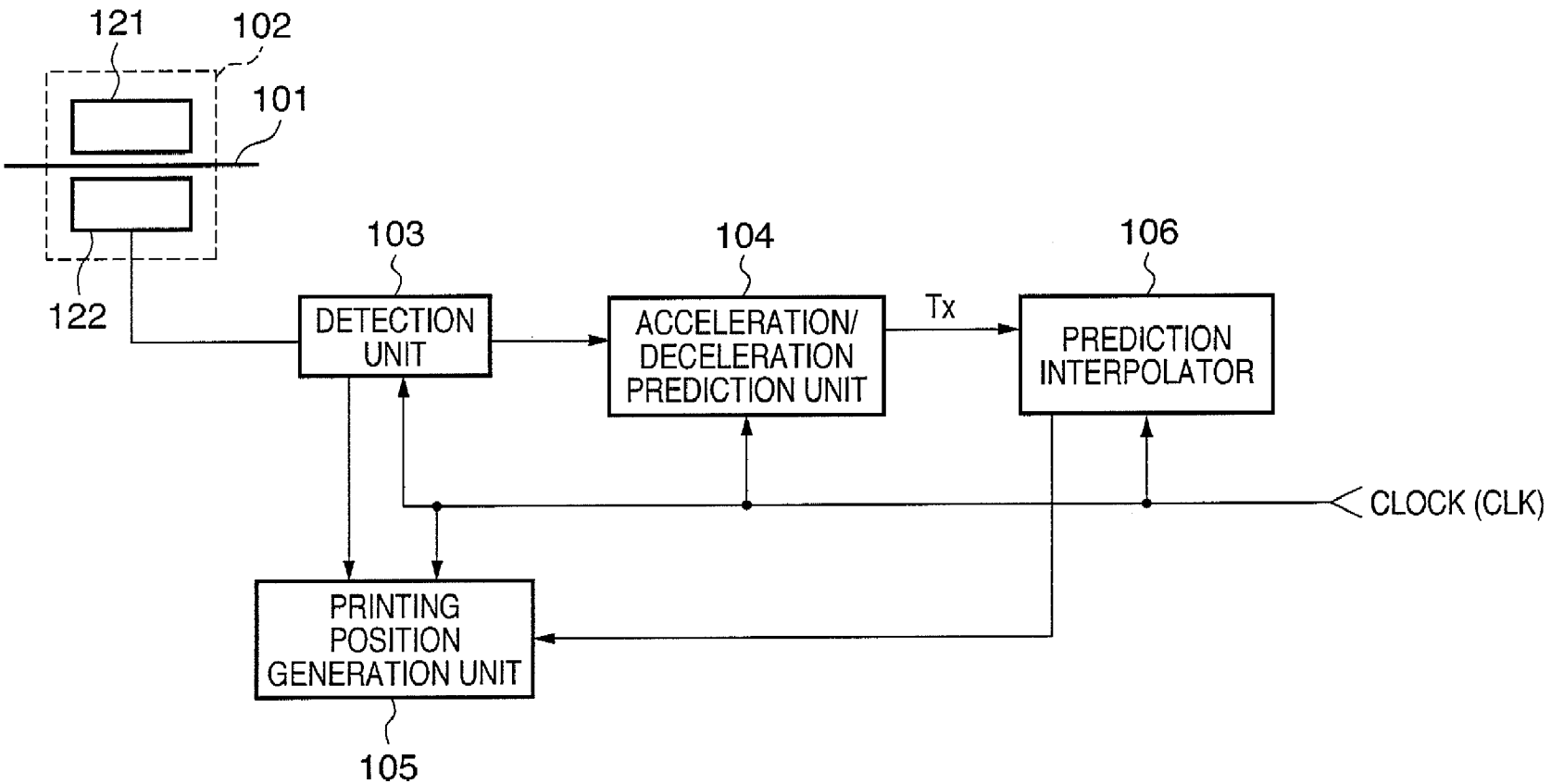
FIG. 8 is a block diagram showing a carriage position detection unit in an apparatus disclosed in Japanese Patent Laid-Open No. 2002-277231.

As is apparent from the comparison between FIGS. 4 and 8, a remarkable feature of the carriage position detection unit of this embodiment is to provide an acceleration/deceleration prediction interpolator 107 in place of the conventional prediction interpolator.

The acceleration/deceleration prediction interpolator (interpolation predictor) 107 will be described below.

Figure 5A:
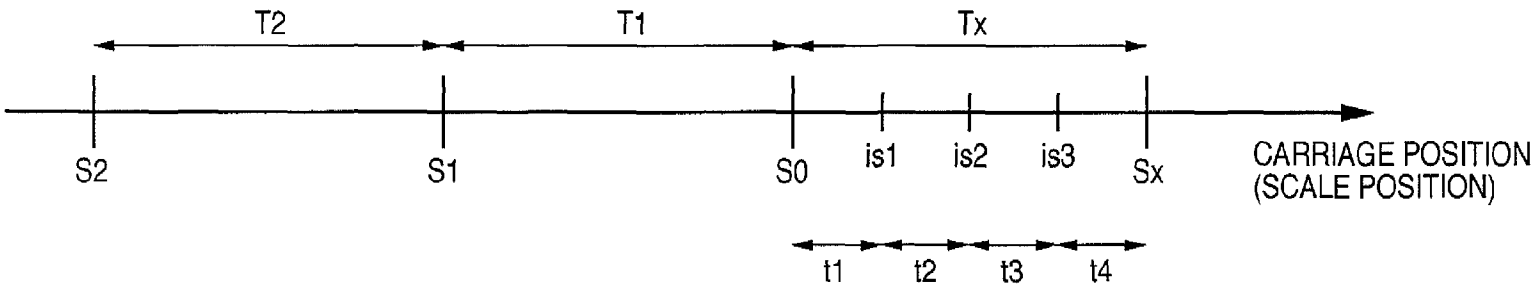
FIGS. 5A and 5B are schematic views showing the relationship between a scale and the timing of detection of a slit in the scale.
Figure 5B:
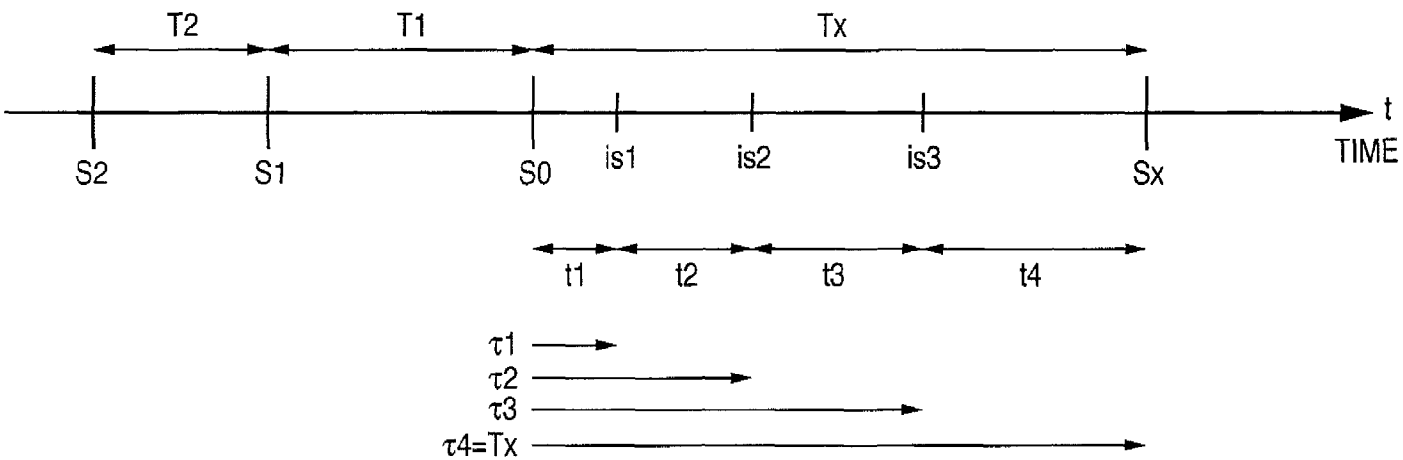

FIGS. 5A and 5B are schematic views showing the relationship between a scale and the timing of detection of a slit in the scale.

Referring to FIGS. 5A and 5B, S0 indicates a slit position currently detected by an encoder sensor 102 of the carriage 2. S1 indicates a slit position detected immediately before, and S2 indicates a slit position detected immediately before S1. T1 indicates a time interval between the detection time of the slit S0 and that of the slit S1. T2 indicates a time interval between the detection time of the slit S1 and that of the slit S2. Tx indicates a predicted time interval between the detection time (measurement time) of the slit S0 and the predicted detection time of a next slit Sx.

The encoder sensor 102 outputs encoder signals at the slit positions S0, S1, and S2. Hence, S0, S1, and S2 can also be regarded as encoder signal output timings.

Additionally, is1, is2, and is3 indicate positions in the section between the slit position S0 and the slit position Sx, and t1, t2, t3, and t4 indicate time intervals (very narrow time intervals in the section) between the positions. The printhead 3 discharges ink and prints even at the intrasection positions is1, is2, and is3. In other words, in this embodiment, printing is executed at a resolution higher than the spatial resolution of the slits.

The intrasection positions is1, is2, and is3 are obtained by interpolating the section between the slits in the scale 8. In the example shown in FIGS. 5A and 5B, the section between the slits in the scale 8 is divided into four parts (that is, three intrasection positions are obtained).

The abscissa of FIG. 5A represents a carriage position (scale position) which changes as the carriage moves. The abscissa of FIG. 5B represents a time elapsed as the carriage moves. In other words, FIG. 5A represents progress of carriage movement as a spatial position change, and FIG. 5B represents it as the elapse of time.

For the descriptive convenience of the embodiment, FIGS. 5A and 5B schematically show carriage position detection when the carriage moves while being decelerated. Hence, the time intervals have a relationship $t1<t2<t3<t4$.

The acceleration/deceleration prediction interpolator 107 of this embodiment is designed to generate information corresponding to the intrasection positions is1, is2, and is3 in FIG. 5B.

The information generation method will be described more specifically.

Generally, letting t be the time, and v be the velocity, an acceleration a is physically represented by $a=dv/dt$. Letting $\Delta t$ be the very small time change, and $\Delta v$ be the velocity change, the acceleration a can be approximated to $a=\Delta v/\Delta t$.

That is, $\Delta v=a\cdot\Delta t$, and $\Delta t=\Delta v/a$. The time change, that is, the very small time difference is proportional to the velocity change. In the very small section, the velocity change $\Delta v$ in the predicted time interval can be assumed to be constant. That is, the acceleration is assumed to be constant in the very small section.

Then, the time change $\Delta t$ in the predicted time interval is also constant.

This is applied to the predicted time interval (Tx). A time change $\delta t$ at the time intervals (t1 to t4) corresponding to the interpolated printing positions in the predicted time interval corresponds to $\Delta t$ and is constant. This indicates that the time intervals (t1 to t4) corresponding to the interpolated printing positions equivalently represent a velocity. For this reason, the velocity change, that is, time change is represented by the change in time intervals (t1 to t4) corresponding to the interpolated printing positions. Complementarily, $t2=t1+\delta t$, $t3=t2+\delta t$, $t4=t3+\delta t$.

The m-th time interval and (m+1)th time interval can be represented by $tm+1=tm+\delta t$ using the constant time change ($\delta t$). This can be regarded as an arithmetic series.

Using the first term (t1), the arithmetic series can be rewritten to $$tm=(m-1)\cdot\delta t+t1 \quad (1)$$

The sum of the time intervals is equivalent to the predicted time (Tx).

Generally, let n be the number of sections (n=4 in FIGS. 5A and 5B). A sum Sn of the very narrow time intervals in the sections is given by $$\begin{aligned} Sn &= \Sigma(tm) \\ &= Tx \\ &= (n/2)\cdot(t1+tn) \\ &= (n/2)\cdot(t1+(n-1)\cdot\delta t+t1) \\ &= n\cdot t1+(1/2)\cdot n\cdot(n-1)\cdot\delta t \end{aligned}$$

The first term on the right-hand side is fixed, and the second term depends on the very small time changes in the sections.

Consider the second term on the right-hand side as the difference between the actual time (T1) immediately before and the predicted time (Tx). Then, we obtain $$\Delta T=Tx-T1=(1/2)\cdot n\cdot(n-1)\cdot\delta t$$

Hence, δt is given by $$\delta t=\Delta T/((1/2)\cdot n\cdot(n-1)) \quad (2)$$

The constant term of the section represented by the first term on the right-hand side indicates the actual time (T1) immediately before.

That is, T1=n·t1. Hence, t1 is given by $$t1=T1/n \quad (3)$$

Based on equations (2) and (3), equation (1) can be rewritten to $$tm=\{\Delta T/((1/2)\cdot n\cdot(n-1))\}\cdot(m-1)+T1/n \quad (4)$$

where n=the number of very small sections in the predicted section, and m=1 to n.

In equation (4), ((1/2)·n·(n−1)) is a fixed constant, and therefore, Δt is distributed such that the time intervals of the very small sections have equal differences. In other words, the predicted time interval (Tx) is divided into a plurality of time intervals (periods). The time interval division is made such that the values of the divided time intervals have the relationship of an arithmetic progression.

As described above, in this embodiment, the time difference between the predicted time (Tx) and the preceding time interval (T1) is distributed to predicted interpolated time intervals with equal differences. Hence, the acceleration/deceleration prediction interpolator 107 can obtain the time intervals (tm) in the very small sections by receiving the predicted time (Tx) and the actual time (T1) immediately before the predicted time from an acceleration/deceleration prediction unit 104.

The very small sections may contain errors. As another method, a time interval (τm) from the immediately preceding slit to the very small sections is used in place of the time interval of the very small sections. In this case, $$\begin{aligned} \tau m &= Sm \quad (5) \\ &= m\cdot(T1/n)+(1/2)\cdot m\cdot(m-1)\cdot \\ &\quad \{\Delta T/((1/2)\cdot n\cdot(n-1))\} \end{aligned}$$

For example, when n=4, and the method of predicting tx is represented by Tx=2·T1−T2 by using the simplest calculation method described in Japanese Patent Laid-Open No. 2002-277231, ΔT=Tx−T1 is rewritten to $$\Delta T=T1-T2$$

An example of this case will be described below.

From equation (4), we obtain $$tm=\{(T1-T2)/6\}\cdot(m-1)+T1/4$$

From equation (5), this can more simply be expressed as $$\tau m=m\cdot(t1/4)+m\cdot(m-1)\cdot((t1-t2)/12)$$

Figure 6:
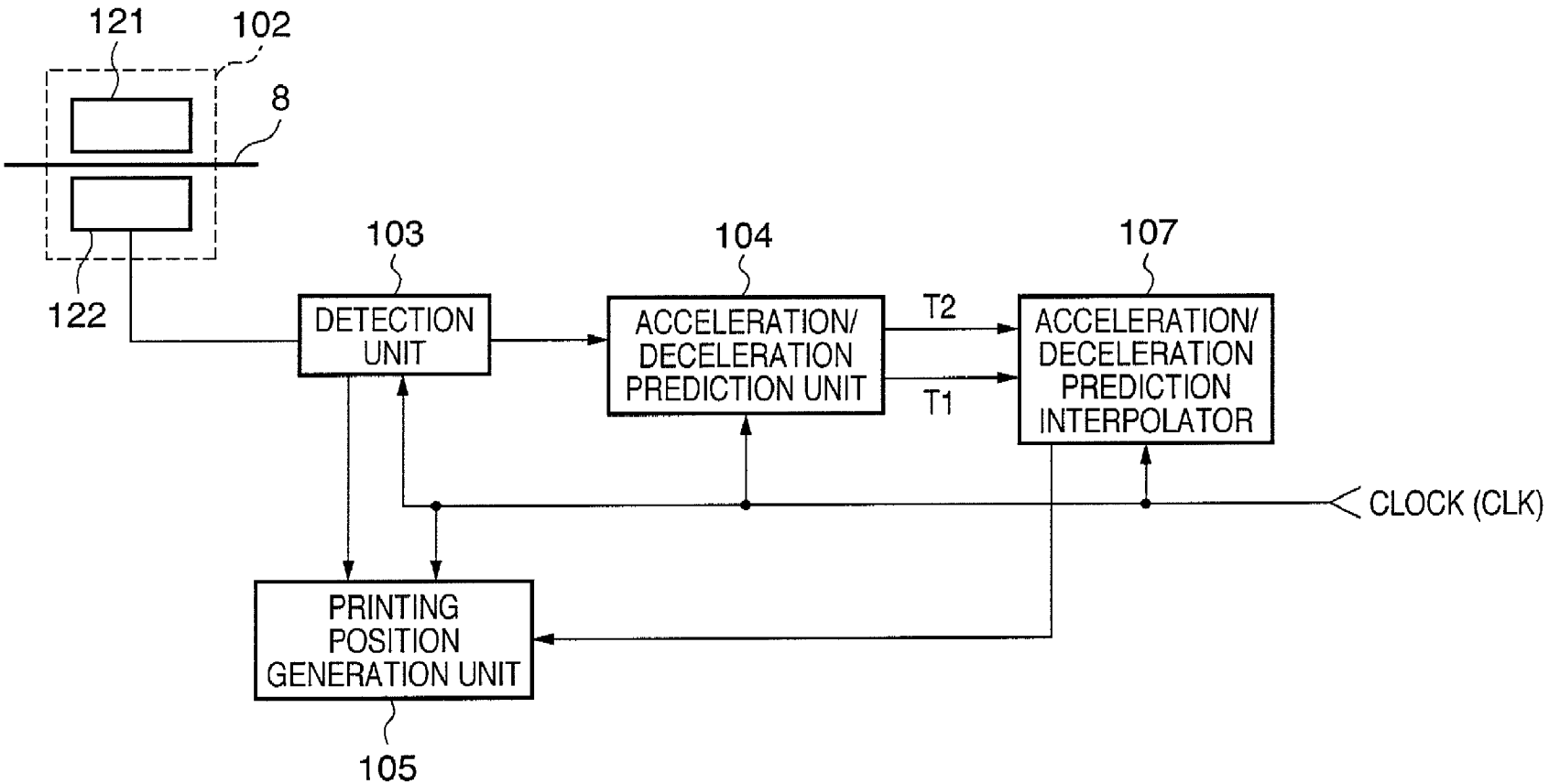
FIG. 6 is a block diagram showing an arrangement in which the output signal from an acceleration/deceleration prediction unit to an acceleration/deceleration prediction interpolator is different from that of the example described in FIG. 4.
Figure 7:
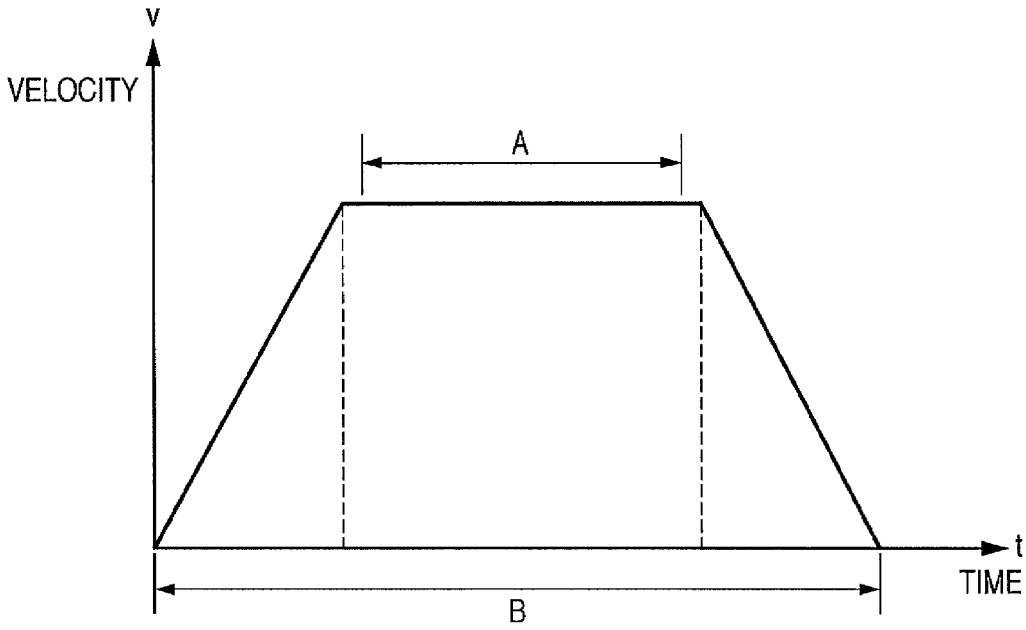
FIG. 7 is a graph showing the relationship between the carriage moving speed and the time.

FIG. 6 is a block diagram showing an arrangement in which the output signal from an acceleration/deceleration prediction unit to an acceleration/deceleration prediction interpolator is different from that of the example described in FIG. 4.

The arrangement shown in FIG. 6 is different from that in FIG. 4 only in that the signals supplied to the acceleration/deceleration prediction interpolator 107 change from (Tx and T1) to (T1 and T2), and a description thereof will be omitted.

In equations (4) and (5), when m=n, the carriage position is equivalent to the position of the predicted time tx where the signal of an actual slit is expected to be output. Hence, actual control is made within the range of m=1 to (n−1).

Equations (4) and (5) can be handled in the same way for the purpose of calculating the interpolated printing positions.

More specifically, in equation (4), each interpolated printing position serves as the reference position to calculate the next interpolated printing position. On the other hand, in equation (5), each interpolated printing position is calculated based on a position represented by the signal of an immediately preceding slit. That is, the two equations are different only in the position used as the reference.

From the viewpoint of accuracy, equation (5) is more preferable for implementation (circuit implementation or software implementation) in an apparatus because equation (4) accumulates calculation errors.

From the viewpoint of easy implementation in an apparatus, equation (4) is more preferable.

This is because the number of terms to be calculated is small, and this reduces the implementation load. In software processing, equation (4) is suitable for a fast operation because the calculation time is short, and the processing speed is high. In hardware processing, the circuit scale is small, and the manufacturing cost decreases.

More specifically, since the second term (t1/*n*) on the right-hand side of equation (4) is fixed with respect to m and needs to be calculated only once. In (1/2)·n·(n−1) of the first term on the right-hand side of equation (4), n is a fixed constant known in advance. Hence, the calculation of the first term is easy.

To further simplify the calculation of the first term, $$\alpha m=(m-1)/((1/2)\cdot n\cdot(n-1)$$

is calculated in advance and held in, for example, a numerical table. Since the change in the value m is also known in advance, the calculation or processing can be made more easily.

According to the above-described embodiment, the time intervals of the very small sections can be predicted by using the actually measured time interval between the slit immediately before the time intervals to be predicted and the second preceding slit, and that between the second preceding slit and the third preceding slit. Unlike the prior art, it is possible to more accurately predict the time intervals of the very small sections in consideration of the past tendency by dividing the predicted time into equal parts. This allows executing printing at a resolution higher than the slit resolution.

Figure 9:
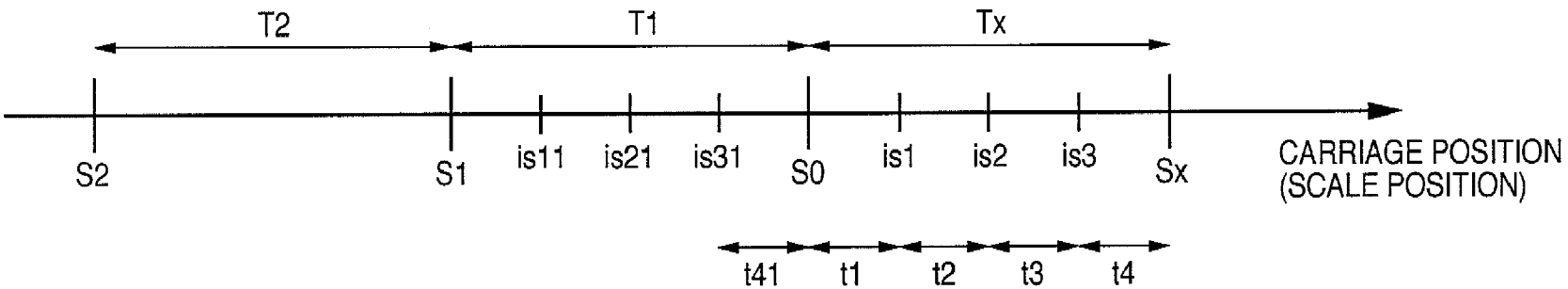
FIG. 9 is a schematic view showing the relationship between a scale and the timing of detection of a slit in the scale.

As another form, a time interval in the immediately preceding actual time T1 may be used to calculate the intrasection positions is1, is2, and is3. For example, the intrasection positions may be calculated based on a period t41 from a position is31 to the position S0 in FIG. 9. Letting t0 be the time interval of the period t41, the sum of the intervals t0 to t4 is obtained.

For example, $$Sn + t0 = \Sigma(tm)$$

$$= (k/2)\cdot(t0 + tk)$$

where k=n+1.

When the intermediate equations are omitted, we obtain $$Sn = n\cdot t0 + (n+1)\cdot n\cdot \delta t/2$$

Hence, δt is given by $$\delta t = \Delta T/\{(1/2)\cdot(n+1)\cdot n\}$$

The intervals of the interpolated printing positions can have equal differences over a plurality of sections.

As still another form, not the actual time T1 but the time interval obtained by the preceding operation may be used in the immediately preceding section.

A complementary explanation of the acceleration/deceleration prediction unit 104 will be made. The acceleration/deceleration prediction unit 104 calculates Tx based on the detection signal output from the detection unit 103. The detection unit 103 knows in advance a count value corresponding to the acceleration control end position, a count value corresponding to the deceleration control start position, and a count value corresponding to the stop position.

For example, if the position S0 shown in FIGS. 5A and 5B is the deceleration control start position, an initial value Tx0 is assumed to correspond to the deceleration control command value in advance. If the position S0 shown in FIGS. 5A and 5B is the acceleration control end position, the initial value Tx0 is assumed to correspond to the constant-velocity control command value in advance.

In the above-described embodiment, the printhead discharges ink droplets, and the liquid contained in the ink tank is ink. However, the liquid is not limited to ink. For example, the ink tank may contain, for example, a processed liquid which is discharged to a printing medium to increase the fixing effect and water repellency of a printed image or increase the printed image quality.

The above-described embodiment particularly uses, of the inkjet printing methods, a method of changing the ink state by thermal energy generated by a means (e.g., electrothermal transducers) for generating thermal energy for ink discharge. Hence it is possible to increase the density and resolution of printing.

Furthermore, the inkjet printing apparatus of the present invention can take not only the form of an image output device for an information processing apparatus such as a computer but also the form of a copying machine combined with a reader or a facsimile apparatus having transmitting and receiving functions.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-041273, filed Feb. 21, 2007, which is hereby incorporated by reference herein in its entirety.

What is claimed is:

1. A printing apparatus for printing with a printhead, comprising:

a carriage configured to reciprocally move and to which the printhead is mounted;

a generation unit configured to time-sequentially generate a plurality of signals indicating positions of the carriage according to the movement of the carriage, wherein at least one of the plurality of signals is outputted each time the carriage moves a certain distance;

a prediction unit configured to, based on a first timing and a second timing at which a first signal and a second signal of the plurality of signals are respectively outputted, predict a third timing at which a next signal of the plurality of signals is to be outputted;

a calculation unit configured to calculate driving timings of the printhead for each of a plurality of positions obtained from dividing a moving distance of the carriage during a period between the second timing and the predicted third timing into equidistant parts; and a driving unit configured to drive the printhead at the driving timings.

2. A method of controlling a printing apparatus for printing with a printhead, comprising the steps of:

time-sequentially generating a plurality of signals indicating positions of a carriage to which the printhead is mounted, according to a reciprocal movement of the carriage, wherein at least one of the plurality of signals is outputted each time the carriage moves a certain distance;

predicting, based on a first timing and a second timing at which a first signal and a second signal of the plurality of signals are respectively outputted, a third timing at which a next signal of the plurality of signals is to be outputted;

calculating driving timings of the printhead for each of a plurality of positions obtained from dividing a moving distance of the carriage during a period between the second timing and the predicted third timing into equidistant parts; and driving the printhead at the driving timings.

3. The printing apparatus according to claim 1, wherein said generation unit includes a scale, having slits at predetermined intervals, provided along a moving direction of the carriage, and an encoder sensor provided on the carriage to detect the slits of the scale as the carriage moves.

4. The apparatus according to claim 3, wherein the encoder sensor includes a light-emitting element which irradiates the scale with light, and a light-receiving element which receives the light, which has passed through the slits of the scale.

5. The apparatus according to claim 1, wherein the printhead is an inkjet printhead which performs printing by discharging ink to a printing medium.

6. A method of outputting positional information for a reciprocally and linearly moving object, comprising the steps of:

driving the object in a reciprocal linear manner with an object driving motor;

time-sequentially generating a plurality of signals indicating positions of the object, according to a reciprocal linear movement of the object, wherein at least one of the plurality of signals is outputted each time the object moves a certain distance;

predicting, based on a first timing and a second timing at which a first signal and a second signal of the plurality of signals are respectively outputted, a third timing at which a next signal of the plurality of signals is to be outputted; and calculating time intervals measured from the second timing at each of a plurality of positions obtained from dividing a moving distance of the object during a period between the second timing and the predicted third timing into equidistant parts.

7. The printing apparatus according to claim 1, wherein the calculation unit is further configured to assume a constant acceleration of the carriage during the period between the second timing and the predicted third timing.

8. The printing method according to claim 2, wherein a constant acceleration of the carriage is assumed during the period between the second timing and the predicted third timing in the calculating step.

9. The method of outputting positional information according to claim 6, wherein a constant acceleration of the object is assumed during the period between the second timing and the predicted third timing in the calculating step.

* * * * *